US011492900B2

(12) United States Patent
Wright et al.

(10) Patent No.: US 11,492,900 B2
(45) Date of Patent: Nov. 8, 2022

(54) GAS RATIO VOLUMETRICS FOR RESERVOIR NAVIGATION

(71) Applicants: Mat Wright, Secret Harbour (AU); Nicklas Jeremias Ritzmann, Niedersachsen (DE)

(72) Inventors: Mat Wright, Secret Harbour (AU); Nicklas Jeremias Ritzmann, Niedersachsen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/433,185

(22) Filed: Jun. 6, 2019

(65) Prior Publication Data

US 2019/0376386 A1 Dec. 12, 2019

Related U.S. Application Data

(60) Provisional application No. 62/683,715, filed on Jun. 12, 2018.

(51) Int. Cl.

| | |
|---|---|
| ***E21B 49/00*** | (2006.01) |
| ***E21B 7/04*** | (2006.01) |
| ***E21B 44/00*** | (2006.01) |

(52) U.S. Cl.

CPC ..... *E21B 49/005* (2013.01); *E21B 7/04* (2013.01); *E21B 44/00* (2013.01)

(58) Field of Classification Search

CPC ..... E21B 49/005; E21B 7/04; E21B 44/00

See application file for complete search history.

(56) References Cited

U.S. PATENT DOCUMENTS

| | | | | |
|---|---|---|---|---|
| 6,715,347 | B2 * | 4/2004 | Zamfes | G01N 15/042 73/152.05 |
| 7,775,297 | B2 * | 8/2010 | Hopwood | E21B 44/00 175/25 |
| 8,061,444 | B2 * | 11/2011 | Mullins | E21B 47/022 175/50 |
| 8,200,465 | B2 | 6/2012 | Suarez-Rivera et al. | |
| 8,561,720 | B2 | 10/2013 | Edbury et al. | |
| 8,714,246 | B2 | 5/2014 | Pop et al. | |
| 8,967,249 | B2 | 3/2015 | Akkurt et al. | |

(Continued)

FOREIGN PATENT DOCUMENTS

| | | | |
|---|---|---|---|
| CA | 2867580 | A1 | 4/2015 |
| WO | 2017116436 | A1 | 7/2017 |

OTHER PUBLICATIONS

Halliburton, "Reservoir Innovations", A Formation Evaluation Technology Journal, vol. 3, No. 2, 2014 (56 pages).

(Continued)

*Primary Examiner* — Jonathan Malikasim

(74) *Attorney, Agent, or Firm* — Cantor Colburn LLP

(57) ABSTRACT

Methods and systems for controlling drilling operations are described. The methods include conveying a drilling tool from the earth surface into a wellbore and operating the drilling tool to drill in a drilling direction, wherein drilling mud is conveyed from the earth surface to the drilling tool and returned to the earth surface, obtaining gas data from the drilling mud that returns to the earth surface, determining a (Continued)

reservoir property from the gas data, and adjusting the drilling direction based on the determined reservoir property.

23 Claims, 4 Drawing Sheets

(56) References Cited

U.S. PATENT DOCUMENTS

| | | | | |
|---|---|---|---|---|
| 9,004,195 | B2 | 4/2015 | Regener et al. | |
| 9,528,367 | B2 | 12/2016 | Selman et al. | |
| 2009/0293605 | A1 | 12/2009 | Evrard et al. | |
| 2012/0217065 | A1 | 8/2012 | Gray | |
| 2013/0152665 | A1 | 6/2013 | Dunlop et al. | |
| 2014/0291023 | A1 | 10/2014 | Edbury et al. | |
| 2014/0379265 | A1 | 12/2014 | Beda et al. | |
| 2015/0060054 | A1* | 3/2015 | Bordoloi | E21B 49/003 166/250.01 |
| 2015/0134255 | A1 | 5/2015 | Zhang et al. | |
| 2015/0215606 | A1 | 7/2015 | Sasada et al. | |
| 2016/0102510 | A1 | 4/2016 | Mitchell | |
| 2016/0145991 | A1 | 5/2016 | Yarus et al. | |
| 2016/0312609 | A1* | 10/2016 | Ritzmann | E21B 49/08 |
| 2017/0097441 | A1 | 4/2017 | Eiskamp | |
| 2017/0260855 | A1 | 9/2017 | Yang et al. | |

OTHER PUBLICATIONS

Ichenwo et al. "Evaluating optimal well placement in horizontal drilling using geosteering: A case study of Agbada Field, Niger Delta", Journal of Geology and Mining Research vol. 4(6) pp. 118-129, Nov. 2012.

International Search Report, International Application No. PCT/US2019/035473, dated Sep. 26, 2019, Korean Intellectual Property Office; International Search Report 5 pages.

International Written Opinion, International Application No. PCT/US2019/035473, dated Sep. 26, 2019, Korean Intellectual Property Office; International Written Opinion 7 pages.

Kumar et al., "Effective Geosteering Using High-Resolution Electrical Images and Deep Azimuthal Resistivity", Society of Petroleum Engineers, SPE Saudi Arabia Section Annual Technical Symposium and Exhibition, Apr. 21-24, 2014, 11 pages.

Liu et al. "Shale gas sweet spot identification and precise geosteering drilling in Weiyuan Block of Sichuan Basin, SW China", Petrol. Explor. Develop., 2016, 43(6): 1067-1075.

Torre et al. "Geosteering. Full formation evaluation including Sw, K and PhiT using Surface Logging Advanced Gas data", 78th EAGE Conference & Exhibition 2016 Vienna, Austria, 30 May-Jun. 2, 2016 (5 pgs).

* cited by examiner

GAS RATIO VOLUMETRICS FOR RESERVOIR NAVIGATION

CROSS REFERENCE TO RELATED APPLICATIONS

This application claims the benefit of an earlier filing date from U.S. Provisional Application Ser. No. 62/683,715 filed Jun. 12, 2018, the entire disclosure of which is incorporated herein by reference.

BACKGROUND

1. Field of the Invention

The present invention generally relates to downhole operations and drilling navigation using gas ratio volumetrics.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., heat, a gas, or fluid) contained in a formation located below the earth's surface. Different types of tools and instruments may be disposed in the boreholes to perform various tasks and measurements.

When performing downhole operations, and particularly during drilling operation, it is important to know a direction of drilling, to ensure that a desired formation and/or deposit is reached, or to ensure other considerations associated with drilling are accounted for. That is, there is a need to be able to keep the trajectory of wellbores, drilled by e.g., rotary steerable systems, maintained on a desired drilling path. Traditional geosteering techniques may rely upon deep azimuthal resistivity. However, such techniques may have limitations during drilling of high angle/horizontal wells. Accordingly, improved data collection and information for making drilling and steering decisions may be advantageous.

SUMMARY

Disclosed herein are methods and systems to control drilling operations. The methods include conveying a drilling tool from the earth surface into a wellbore and operating the drilling tool to drill in a drilling direction, wherein drilling mud is conveyed from the earth surface to the drilling tool and returned to the earth surface, obtaining gas data from the drilling mud that returns to the earth surface, determining a reservoir property from the gas data, and adjusting the drilling direction based on the determined reservoir property.

The systems for controlling drilling operations include a drilling tool in a wellbore arranged to perform the drilling operation, the drilling operation having a drilling direction, wherein drilling mud is conveyed from the earth surface to the drilling tool and returned to the earth surface, a mud logger operable to obtain gas data from the drilling mud that returns to the earth surface, a control unit configured to determine a reservoir property from the gas data, and one or more geosteering components located at at least one of the surface and downhole configured to adjust the drilling direction based on the determined reservoir property.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

DETAILED DESCRIPTION

Figure 1:
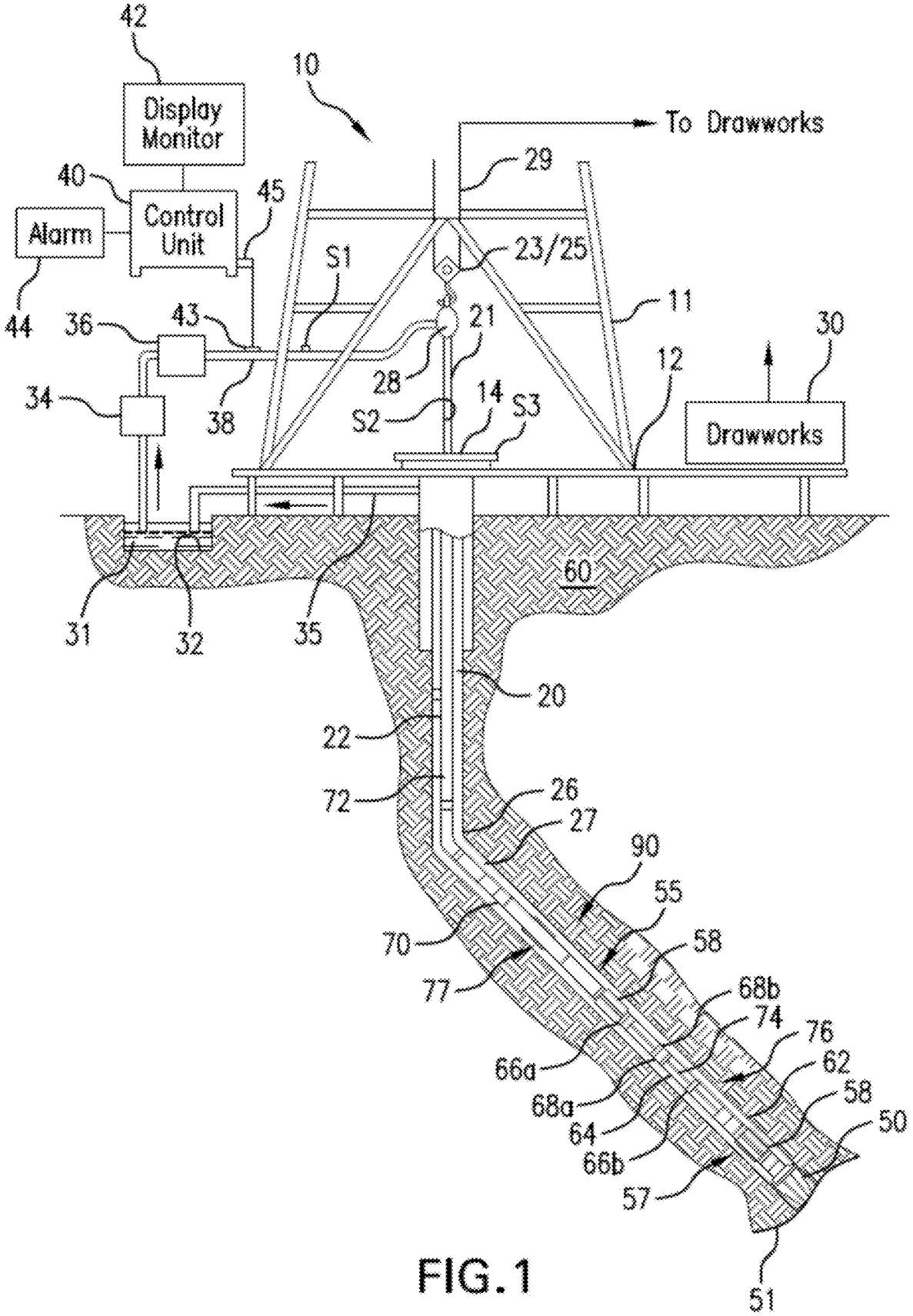
FIG. 1 is an example of a system for performing downhole operations that can employ embodiments of the present disclosure.

FIG. 1 shows a schematic diagram of a system for performing downhole operations. As shown, the system is a drilling system 10 that includes a drill string 20 having a drilling assembly 90, also referred to as a bottomhole assembly (BHA), conveyed in a wellbore or borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegrating tool 50, such as a drill bit attached to the end of the drilling assembly 90, disintegrates the geological formations when it is rotated to drill the borehole 26. The drill string 20 is coupled to a drawworks 30 via a kelly joint 21, swivel 28, traveling block 25, and line 29 through a pulley 23. During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud" or "drilling mud") from a source or mud pit 32 is circulated under pressure through the drill string 20 by a mud pump 34. The drilling fluid 31 passes into the drill string 20 via a desurger 36, fluid line 38 and the kelly joint 21. Fluid line 38 may also be referred to as a mud supply line. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. The return line 35 or mud pit 32 may include a mud logging device to monitor various characteristics and/or properties of the returned mud. For example, the mud logging device may be arranged to monitor gas content, cuttings content, fluid characteristics, etc. of the return flow mud.

A sensor S1 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the borehole 26. The system may further include one or more downhole sensors 70 located on the drill string 20 and/or the drilling assembly 90.

In some applications the disintegrating tool 50 is rotated by rotating the drilling tubular 22. However, in other applications, a drilling motor 55 (such as a mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the formation 60 for a given formation and a drilling assembly largely depends upon the weight on bit and the rotational speed of the disintegrating tool 50. In one aspect of the embodiment of FIG. 1, the drilling motor 55 is coupled to the disintegrating tool 50 via a drive shaft (not shown) disposed in a bearing assembly 57. If a mud motor is employed as the drilling motor 55, the mud motor rotates the disintegrating tool 50 when the drilling fluid 31 passes through the drilling motor 55 under pressure. The bearing assembly 57 supports the radial and axial forces of the disintegrating tool 50, the downthrust of the drilling motor and the reactive upward loading from the applied weight on bit. Stabilizers 58 coupled to the bearing assembly 57 and at other suitable locations on the drill string 20 act as centralizers, for example for the lowermost portion of the drilling motor assembly and other such suitable locations.

A surface control unit 40 receives signals from the downhole sensors 70 and devices via a sensor 43 placed in the fluid line 38 as well as from sensors S1, S2, S3, hook load sensors, sensors to determine the height of the traveling block (block height sensors), and any other sensors used in the system and processes such signals according to programmed instructions provided to the surface control unit 40. For example, a surface depth tracking system may be used that utilizes the block height measurement to determine a length of the borehole (also referred to as measured depth of the borehole) or the distance along the borehole from a reference point at the surface to a predefined location on the drill string 20, such as the disintegrating tool 50 or any other suitable location on the drill string 20 (also referred to as measured depth of that location, e.g. measured depth of the disintegrating tool 50). Determination of measured depth at a specific time may be accomplished by adding the measured block height to the sum of the lengths of all equipment that is already within the wellbore at the time of the block-height measurement, such as, but not limited to drilling tubulars 22, drilling assembly 90, and disintegrating tool 50. Depth correction algorithms may be applied to the measured depth to achieve more accurate depth information. Depth correction algorithms, for example, may account for length variations due to pipe stretch or compression due to temperature, weight-on-bit, wellbore curvature and direction. By monitoring or repeatedly measuring block height, as well as lengths of equipment that is added to the drill string 20 while drilling deeper into the formation over time, pairs of time and depth information are created that allow estimation of the depth of the borehole 26 or any location on the drill string 20 at any given time during a monitoring period. Interpolation schemes may be used when depth information is required at a time between actual measurements. Such devices and techniques for monitoring depth information by a surface depth tracking system are known in the art and therefore are not described in detail herein.

The surface control unit 40 displays desired drilling parameters and other information on a display/monitor 42 for use by an operator at the rig site to control the drilling operations. The surface control unit 40 contains a computer that may comprise memory for storing data, computer programs, models and algorithms accessible to a processor in the computer, a recorder, such as tape unit, memory unit, etc. for recording data and other peripherals. The surface control unit 40 also may include simulation models for use by the computer to process data according to programmed instructions. The control unit responds to user commands entered through a suitable device, such as a keyboard. The control unit 40 can output certain information through an output device, such as s display, a printer, an acoustic output, etc., as will be appreciated by those of skill in the art. The control unit 40 is adapted to activate alarms 44 when certain unsafe or undesirable operating conditions occur.

The drilling assembly 90 may also contain other sensors and devices or tools for providing a variety of measurements relating to the formation 60 surrounding the borehole 26 and for drilling the borehole 26 along a desired path. Such devices may include a device for measuring formation properties, such as the formation resistivity or the formation gamma ray intensity around the borehole 26, near and/or in front of the disintegrating tool 50 and devices for determining the inclination, azimuth and/or position of the drill string. A logging-while-drilling (LWD) device for measuring formation properties, such as a formation resistivity tool 64 or a gamma ray device 76 for measuring the formation gamma ray intensity, made according an embodiment described herein may be coupled to the drill string 20 including the drilling assembly 90 at any suitable location. For example, coupling can be above a lower kick-off subassembly 62 for estimating or determining the resistivity of the formation 60 around the drill string 20 including the drilling assembly 90. Another location may be near or in front of the disintegrating tool 50, or at other suitable locations. A directional survey tool 74 that may comprise means to determine the direction of the drilling assembly 90 with respect to a reference direction (e.g., magnetic north, vertical up or down direction, etc.), such as a magnetometer, gravimeter/accelerometer, gyroscope, etc. may be suitably placed for determining the direction of the drilling assembly, such as the inclination, the azimuth, and/or the toolface of the drilling assembly. Any suitable direction survey tool may be utilized. For example, the directional survey tool 74 may utilize a gravimeter, a magnetometer, or a gyroscopic device to determine the drill string direction (e.g., inclination, azimuth, and/or toolface). Such devices are known in the art and therefore are not described in detail herein.

Direction of the drilling assembly may be monitored or repeatedly determined to allow for, in conjunction with depth measurements as described above, the determination of a wellbore trajectory in a three-dimensional space. In the above-described example configuration, the drilling motor 55 transfers power to the disintegrating tool 50 via a shaft (not shown), such as a hollow shaft, that also enables the drilling fluid 31 to pass from the drilling motor 55 to the disintegrating tool 50. In alternative embodiments, one or more of the parts described above may appear in a different order, or may be omitted from the equipment described above.

Still referring to FIG. 1, other LWD devices (generally denoted herein by numeral 77), such as devices for measuring rock properties or fluid properties, such as, but not limited to, porosity, permeability, density, salt saturation, viscosity, permittivity, sound speed, etc. may be placed at suitable locations in the drilling assembly 90 for providing information useful for evaluating the subsurface formations 60 or fluids along borehole 26. Such devices may include, but are not limited to, acoustic tools, nuclear tools, nuclear magnetic resonance tools, permittivity tools, and formation testing and sampling tools.

The above-noted devices may store data to a memory downhole and/or transmit data to a downhole telemetry system 72, which in turn transmits the received data uphole to the surface control unit 40. The downhole telemetry system 72 may also receive signals and data from the surface control unit 40 and may transmit such received signals and data to the appropriate downhole devices. In one aspect, a mud pulse telemetry system may be used to communicate data between the downhole sensors 70 and devices and the surface equipment during drilling operations. A sensor 43 placed in the fluid line 38 may detect the mud pressure variations, such as mud pulses responsive to the data transmitted by the downhole telemetry system 72. Sensor 43 may generate signals (e.g., electrical signals) in response to the mud pressure variations and may transmit such signals via a conductor 45 or wirelessly to the surface control unit 40. In other aspects, any other suitable telemetry system may be used for one-way or two-way data communication between the surface and the drilling assembly 90, including but not limited to, a wireless telemetry system, such as an acoustic telemetry system, an electro-magnetic telemetry system, a wired pipe, or any combination thereof. The data communication system may utilize repeaters in the drill string or the wellbore. One or more wired pipes may be made up by joining drill pipe sections, wherein each pipe section includes a data communication link that runs along the pipe. The data connection between the pipe sections may be made by any suitable method, including but not limited to, electrical or optical line connections, including optical, induction, capacitive or resonant coupling methods. A data communication link may also be run along a side of the drill string 20, for example, if coiled tubing is employed.

The drilling system described thus far relates to those drilling systems that utilize a drill pipe to convey the drilling assembly 90 into the borehole 26, wherein the weight on bit is controlled from the surface, typically by controlling the operation of the drawworks. However, a large number of the current drilling systems, especially for drilling highly deviated and horizontal wellbores, utilize coiled-tubing for conveying the drilling assembly downhole. In such application a thruster is sometimes deployed in the drill string to provide the desired force on the disintegrating tool 50. Also, when coiled-tubing is utilized, the tubing is not rotated by a rotary table but instead it is injected into the wellbore by a suitable injector while a downhole motor, such as drilling motor 55, rotates the disintegrating tool 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* or and receivers 68*a* or 68*b*. Resistivity can be one formation property that is of interest in making drilling decisions. Those of skill in the art will appreciate that other formation property tools can be employed with or in place of the resistivity tool 64.

Liner drilling or casing drilling can be one configuration or operation used for providing a disintegrating device that becomes more and more attractive in the oil and gas industry as it has several advantages compared to conventional drilling. One example of such configuration is shown and described in commonly owned U.S. Pat. No. 9,004,195, entitled "Apparatus and Method for Drilling a Wellbore, Setting a Liner and Cementing the Wellbore During a Single Trip," which is incorporated herein by reference in its entirety. Importantly, despite a relatively low rate of penetration, the time of getting a liner to target is reduced because the liner is run in-hole while drilling the wellbore simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Although FIG. 1 is shown and described with respect to a drilling operation, those of skill in the art will appreciate that similar configurations, albeit with different components, can be used for performing different downhole operations. For example, wireline, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired downhole operation(s).

There is a need to be able to ensure a desired trajectory of a wellbores drilled by, e.g., rotary steerable systems, is maintained. Good straightness can increase the rate of penetration as well as it improve the ability to run casing after the drilling operation is complete. While inclination control is readily available, simple, and easily employed (e.g., often using a simple inclination measurement by accelerometer), azimuthal (e.g., horizontal plane) direction control of the drilling operation, and thus the drilled borehole can be more difficult. For example, because of the vicinity to a magnetic influence of a drill bit (or other parts of a bottom hole assembly) and because of a possible lack of sensors or suitable navigational grade sensors, i.e. magnetometers, it may be difficult to measure the azimuth of the borehole precisely, particularly during rotation of the drilling tool (e.g., rotary steerable system). There may also be a lack of information (e.g., magnetic dip at current location, etc.) that may prevent a direct calculation of azimuth.

Further, in reservoirs with poor formation evaluation data contrast, traditional geosteering methods using technology such as resistivity (e.g., azimuthal resistivity), gamma (e.g., azimuthal gamma), porosity (e.g., azimuthal porosity), density (e.g., azimuthal density), and/or nuclear magnetic resonance (e.g., azimuthal nuclear magnetic resonance), etc. may be inadequate to determine an optimum drilling trajectory for a high angle/horizontal well. Those skilled in the art will understand that "horizontal well" in this context does not necessarily mean a well with an inclination of 90 degrees. Rather, in this disclosure, the terms "horizontal well," high angle well," horizontal borehole section," "highly deviated well," and the like describe boreholes or wells that are more horizontal than vertical. For example, the terms "horizontal well," high angle well," horizontal borehole section," "highly deviated well," and the like may describe boreholes or wells with an inclination equal to or higher than 45 degrees. Accordingly, embodiments provided herein are directed to navigating and steering a drilling operation using gas volumetrics calculated based on hydrocarbon ratios (e.g., normalised for ROP/borehole size) and traditional methods to enhance real time interpretation. Incorporating real time gas analysis volumetrics with conventional methods such as offset well correlation may ensure that the wellbore is exposed to the optimal reservoir properties within low contrast reservoirs.

Embodiments provided herein are directed to employing gas analysis on real time gas data extracted or obtained from return flow mud during a drilling operation. In some embodiments, the gas data may be processed in batches (and normalized for ROP and caliper) to identify current wellbore volumetrics (e.g., porosity, saturation, permeability index, fluid type, etc.). The extracted wellbore volumetrics may be combined with offset well correlation information to enable decisions and/or geosteering control to ensure that the drilling operation is maintained in a desired (e.g., current) zone, or may be used to change zones to achieve drilling in and through a formation with better or more desirable properties. Advantageously, embodiments provided herein are directed to employing real-time petrophysical interpretation based on gas ratio rather than formation evaluation tools. This interpretation in high angle or horizontal wells can be combined with conventional geosteering methods (e.g., gamma ray, resistivity, porosity/density (such as neutron porosity/density), etc.).

Wellsite geochemistry datasets may be obtained through data logging and/or mud logging at the surface. The mud logging monitors the return flow of drilling mud at the surface. The drilling mud in the return flow has interacted with the drilled formation and thus any gases contained within and/or trapped in the drilled formation will be mixed into the drilling mud. When the drilling mud is returned to the surface, the drilling mud may be monitored for gas content, composition, and chemistry. For example, various hydrocarbon data (e.g., C1-C8, isomers thereof, etc.) and total gas data may be collected at the wellsite from the return flow drilling mud. A geochemical understanding of the wellbore may be achieved using current drilling data and hydrocarbon data values to provide formation evaluation insight from gas ratios that have been removed from drilling artifacts. Embodiments provided herein may employ data from legacy projects (e.g., prior wells, wells in the same region, simulations, etc.) and/or the current drilling operation. In accordance with some embodiments, the gas data can provide indicators of wellbore hydrocarbon volumetrics, saturations, porosity, and permeability (hereinafter "gas formation indicators"). The gas formation indicators can provide information regarding formation fluid type(s), productive or non-productive zones, potential fluid contacts, reservoir connectivity, natural fractures, etc.

In one non-limiting example, during a drilling operation, mud logging and gas data analysis are performed to extract gas formation indicators. From the gas formation indicators, one or more reservoir properties may be determined (e.g., fluid type, zone information, fluid contacts, connectivity, fractures, etc.). The determined reservoir properties may be combined with formation dip information (typically obtained prior to drilling or while drilling through a specific formation, e.g., determined by an imaging tool or by surface seismic), to predict the bounds (e.g., top) of a given formation through which a drilling operation is being performed. Based on the bounds of the formation, a drilling trajectory may be adjusted to ensure that the drilling is maintained within the formation (if desirable formation) or drilling may be adjusted out of the current formation (if undesirable). Accordingly, embodiments provided herein can be used to maximize high quality reservoir exposure and thus improve drilling, completion, and production efficiencies.

Figure 2:
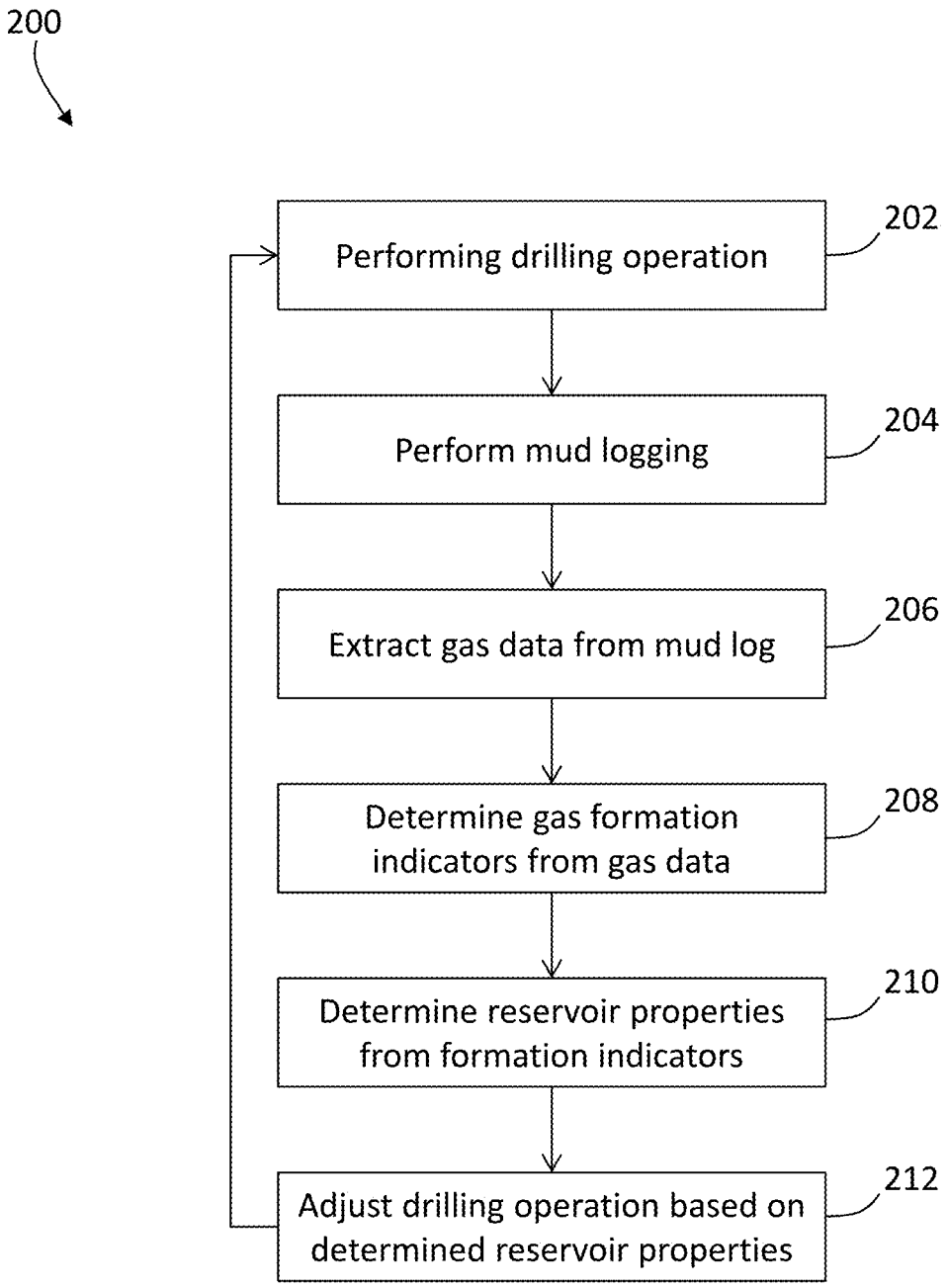
FIG. 2 is a flow process for controlling a drilling operation in accordance with an embodiment of the present disclosure.

For example, turning now to FIG. 2, a flow process 200 in accordance with an embodiment of the present disclosure is shown. The flow process 200 may be used during a drilling operation, such a horizontal drilling operation. The drilling operation may be performed using a drilling system such as shown and described with respect to FIG. 1. The drilling system may include a controller and/or other computer and/or logging systems that are arranged to monitor and/or control various aspects of the drilling operation. The drilling system includes, as least, a mud logging system that is arranged to monitor gas content of a return flow of drilling mud. Further, the drilling system includes one or more components, as known in the art, to control a drilling trajectory of the drilling operation (e.g., geosteering components located at the surfaces and/or downhole).

At block 202, a drilling operation is performed using the drilling system. The drilling operation can include a drill bit and/or disintegrating device (i.e., a downhole drilling element) located within a borehole or wellbore and arranged to extend the length of the borehole. The downhole drilling element can include various components to enable geosteering to allow for controlled drilling trajectory through the earth (e.g., through a formation). During the drilling operation, drilling mud is pumped from the surface and is used to operate at least a portion of the downhole drilling element, as will be appreciated by those of skill in the art. The drilling mud will mix with cuttings of the formation and also incorporate gases and liquids that are released from the formation during the drilling operation. The drilling mud (with the incorporated constituents from the drilling operation) will then flow back up to the surface, where the return flow of the mud may be analyzed using a mud logger and/or other analytical components, as will be appreciated by those of skill in the art.

At block 204, mud logging is performed. The mud logging operation may be a procedure as known in the art. The mud logging may be used to extract various information from the return flow mud, including, but not limited to, drilling operation performance characteristics, formation information, gas data, etc.

At block 206, gas data is extracted from the mud log. The gas data may include gas concentrations, composition, and chemistry. For example, the gas data may be a function of gas concentrations, composition, or chemistry. In some embodiments, the gas data may be processed by standard processing methods, such as filtering or removing of outliers. Alternatively, or in addition thereto, in some embodiments, the gas data may be scaled by a scaling factor. The scaling factor may be constant or variable (e.g., variable with respect to time, depth, gas data, drilling parameter, and/or borehole parameter). In non-limiting examples, the variable scaling factor may be a function of a rate of penetration, a borehole caliper, a flow velocity, a cross-section of the borehole, or another parameter that is related to the geometry of the borehole. In some embodiments, the variable scaling factor may be an exponential function, a polynomial, a linear function, or any combination thereof or one or more of the drilling parameters or borehole parameters.

At block 208, gas formation indicators may be determined from the gas data. The gas formation indicators can include, but are not limited to, wellbore hydrocarbon gas ratios, volumetrics, saturations, porosity, and permeability.

At block 210, the gas formation indicators are used to determine one or more reservoir properties. The reservoir properties may include, but are not limited to, fluid type, zone information, fluid contacts, connectivity, and/or fractures.

At block 212, from the determined reservoir properties, the drilling operation may be adjusted (e.g., adjustment of a drilling direction). For example, a geosteering decision may be based, at least in part, on the determined reservoir properties. In some embodiments the determined reservoir properties based on the gas data may be combined with other information to enable a more efficient and/or accurate decisions for adjusting the drilling operation. For example, in some embodiments, the determined reservoir properties based on the gas data may be combined with formation dip information to determine a formation boundary (e.g., a top). From this information, a geosteering decision can be made to ensure a drilling trajectory is maintained within a formation of interest (or a decision is made to drill out of/away from a formation that is not of interest).

The flow process 200 may be performed continuously, or cyclically, during a drilling operation. For example, once a desired layer within a reservoir is detected, the drilling may be controlled to drill in the desired layer. The flow process 200 may be performed to ensure that the drilling stays within the desired location and to ensure that the drilling does not deviate out of the desire reservoir location. For example, the gas data may be monitored to detect deviations from the desired data properties. If a deviation is detected, the drilling operation may be adjusted or corrected to keep the drilling trajectory within the desired layer, formation, or section thereof. Alternatively, the decision may be made to leave the layer, e.g., by sending a steering command to a steering tool to increase or decrease inclination of the drilling tool.

Figure 3:
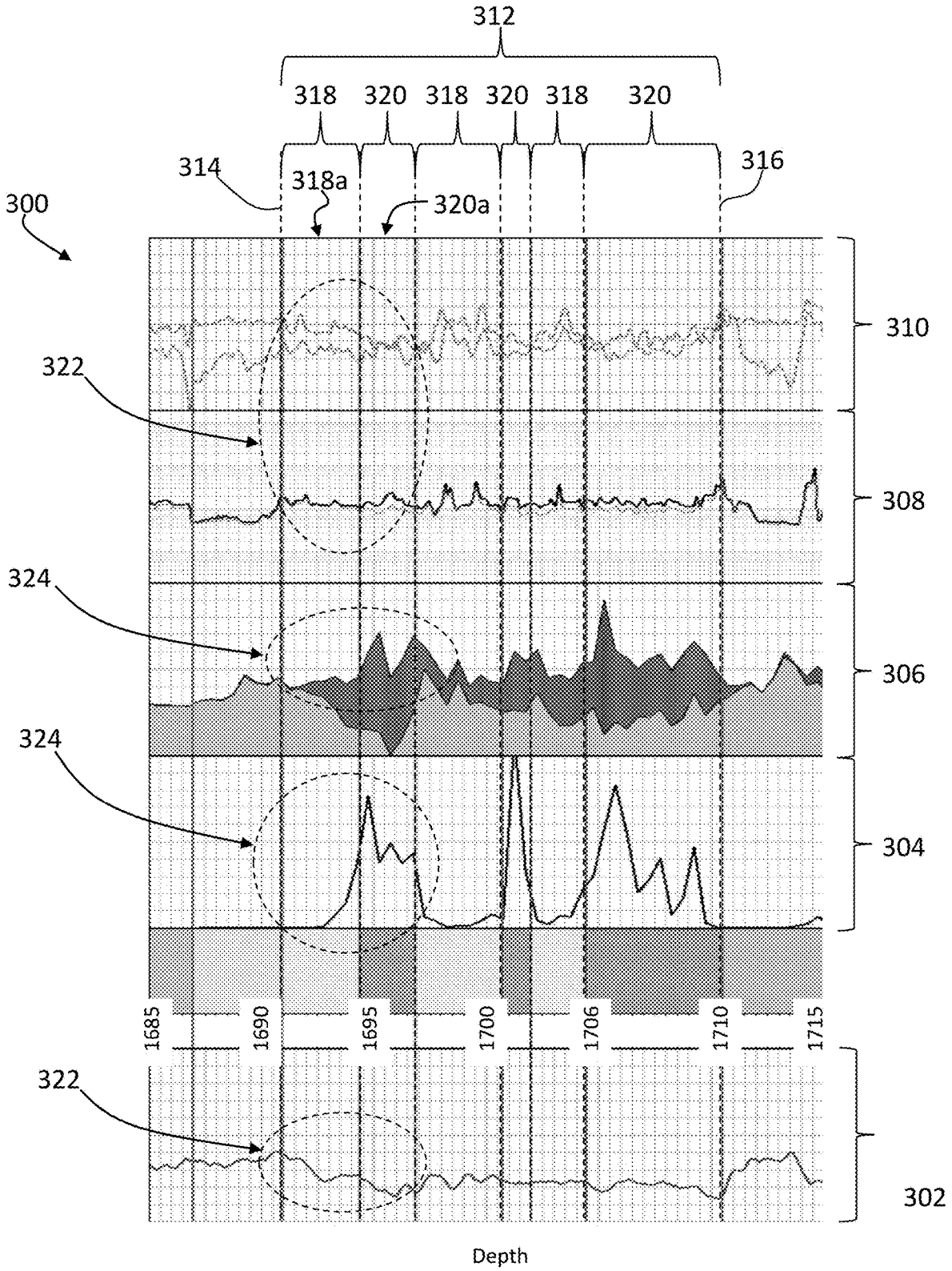
FIG. 3 is a schematic plot of drilling data illustrative of an embodiment of the present disclosure.

FIG. 3 is a schematic plot 300 of example logs obtained during a drilling operation of a vertical well. Those of skill in the art will appreciate that "vertical well" in this context does not necessarily mean a well with an inclination of 0 degrees. Rather, in this disclosure, the terms "vertical well," "low angle well," "vertical borehole section," and the like refer to boreholes or wells that are more vertical than horizontal. For example, the terms "vertical well," "low angle well," "vertical borehole section," and the like may describe boreholes or wells with an inclination of lower than 45 degrees. As shown, the plot 300 includes a gamma ray log 302, a gas permeability index log 304, a gas volumetrics log 306, a resistivity log 308, and a porosity/density log 310. The logs 302-310 span a drilled depth or segment of the vertical well. That is, the logs 302-310 represent logs of the respective characteristics over the same drilled section of a well.

In the plot 300, a reservoir 312 is drilled through, although not all sections of the reservoir 312 are ideal for drilling and/or production. The reservoir 312 extends between a reservoir top 314 and a reservoir base 316. Typical geosteering within a formation is based on gamma ray, resistivity, and/or porosity/density data, such as shown in the gamma ray log 302, the resistivity log 308, and the porosity/density log 310. However, as noted, not all portions of the reservoir 312 may be ideal for production post-drilling. For example, certain portions of the reservoir 312 may have reduced quality oil zones 318. Unfortunately, the traditional data collected, such as the gamma ray log 302, the resistivity log 308, and the porosity/density log 310, and analyzed to determine a geosteering operation may not be able to determine such reduced quality oil zones 318 and/or determine the higher permeability/saturation zones, i.e., high quality zones 320 (or regions of interest) due to the low contrast in the logs.

For example, as shown in FIG. 3, the first section 318*a* of the reservoir 312 may be a reduced quality oil zone 318 and the second section 320*a* of the reservoir 312 (just below the first section) may be a high quality zone 320. However, as shown in first plot regions 322, there is no data within the gamma ray log 302, the resistivity log 308, and the porosity/density log 310 to indicate a difference and/or preference for the first section 318*a* over the second section 320*a* (or vice versa). Accordingly, based on this information along, a geosteering trajectory plan may keep a drilled wellbore within the first section 318*a* for longer than desirable, or may cut through the second section 320*a* for a shorter length than may be desirable. This may be true because the reservoir 312 may be a low resistivity reservoir, and thus the typical data sets/logs may not be sufficient to identify sections of interest for drilling and/or production.

However, with the inclusion of gas data and gas formation indicators in the form of the gas permeability index log 304 and the gas volumetrics log 306, a more informed decision may be made for geosteering operations within the reservoir 312. As shown in second plot regions 324, the gas data and gas formation indicators indicate a change in formation characteristic between the first section 318*a* and the second section 320*a*, as indicated by the spikes in data plots of the gas permeability index log 304 and the gas volumetrics log 306. Accordingly, an operator having access to the gas permeability index log 304 and the gas volumetrics log 306 can determine that a geosteering trajectory control should minimize drilling within the first section 318*a* and maximize drilling within the second section 320*a*. This may be repeated for the other reduced quality oil zones 318 and high quality zones 320 of the reservoir 312, as data is collected in real time during the drilling operation.

The plot 300 of FIG. 3 illustrates the advantage of embodiments of the present disclosure used during drilling of a vertical well. Such advantages may also be realized in a horizontal well.

Figure 4:
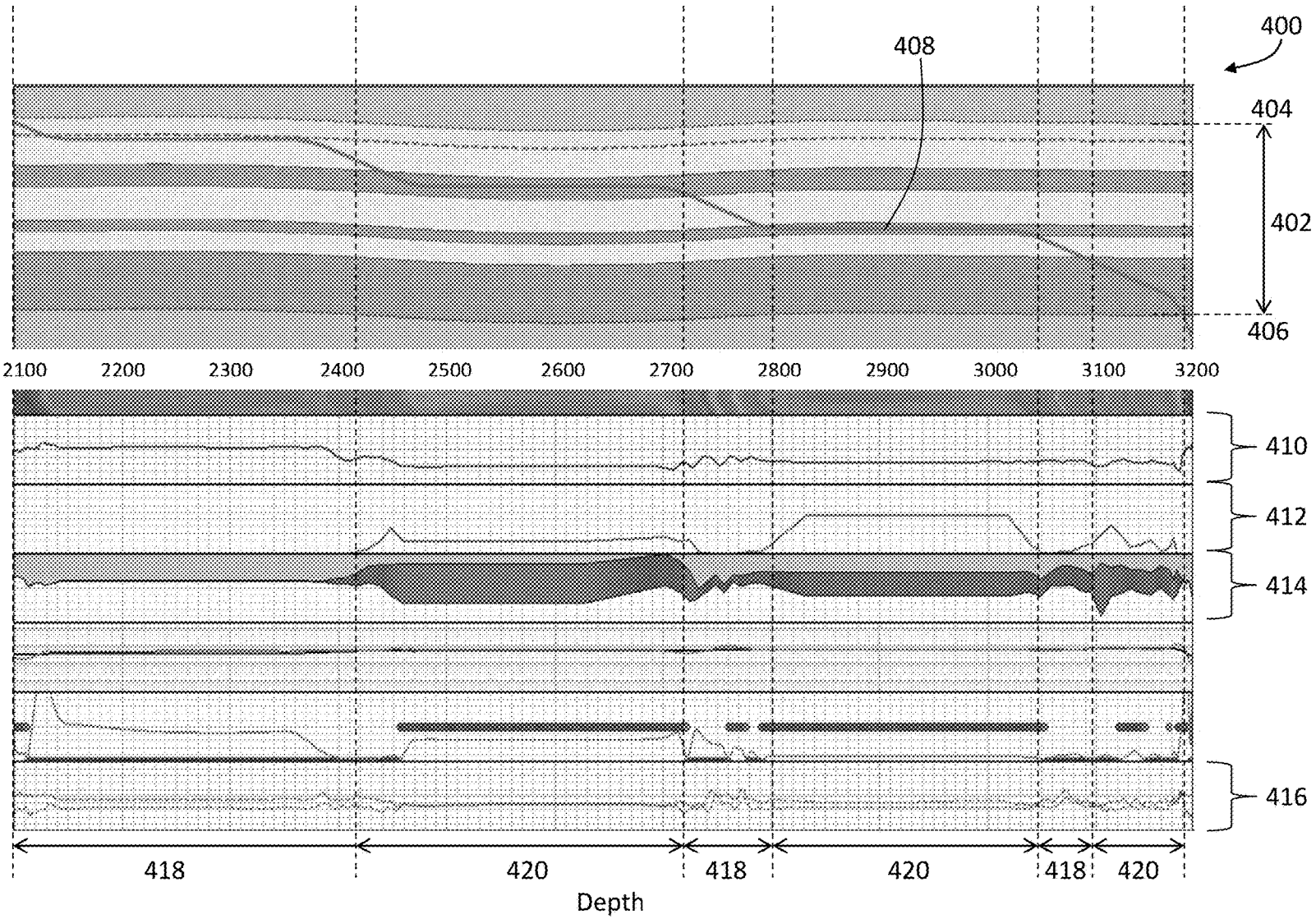
FIG. 4 is a schematic plot of drilling data illustrative of an embodiment of the present disclosure.

For example, turning to FIG. 4, a schematic plot 400 of example logs obtained during a drilling operation of a vertical well. As shown, the plot 400 includes representation of a reservoir 402 having a reservoir top 404 and a reservoir base 406. A well trajectory 408 is shown within the reservoir 402. A gamma ray log 410, a gas permeability index log 412, a gas volumetrics log 414, and a porosity/density log 416 are shown plotted relative to the reservoir 402 and the well trajectory 408.

Although the gamma ray log 410 and the porosity/density log 416 fail to provide an indication of low quality zones and high quality zones, the gas permeability index log 412 and the gas volumetrics log 414 provide such information. For example, the portion of the well trajectory 408 shown in FIG. 4 that passes through the reservoir 402 is separated into low quality zones 418 and high quality zones 420. As illustratively shown, the high quality zones 420 are indicated within the gas data logs (e.g., within the gas permeability index log 412 and the gas volumetrics log 414). Further, as shown, the other logs 410, 416 do not provide any indication of the quality of the reservoir 402.

Advantageously, embodiment provided herein improve the efficiency and accuracy of geosteering within a formation and specifically within a reservoir of the formation. Traditional geosteering based on deep azimuthal resistivity alone may not be the optimal solution in low contrast reservoirs. However, by incorporating conventional geosteering (deep azimuthal reading resistivity), near bit gamma ray data, and real-time image/petrophysical interpretations, along with gas data analysis, a drilling trajectory and/or geosteering can be controlled to ensure a well is drilled in an ideal section or region of a reservoir.

Various thresholds may be used or defined to indicate a "high quality" section versus a "low quality" section of a formation. Data and/or data logs may be monitored for spikes and/or variations in data values to indicate a change in quality of the section of the formation. Various example thresholds that may indicate a 'higher quality' section may include, but are not limited to, at least one of increased hydrocarbon saturation, permeability, porosity and/or desirable fluid type. For example, in the illustration of FIG. 4, high quality zones 420 are indicated as higher quality than low quality zones 418 as the permeability and saturation indicator is elevated in the data logs, and therefore more likely to produce hydrocarbon.

Embodiment 1: A method for controlling a drilling operation, the method comprising: conveying a drilling tool from the earth surface into a wellbore and operating the drilling tool to drill in a drilling direction, wherein drilling mud is conveyed from the earth surface to the drilling tool and returned to the earth surface; obtaining gas data from the drilling mud that returns to the earth surface; determining a reservoir property from the gas data; and adjusting the drilling direction based on the determined reservoir property.

Embodiment 2: The method of the preceding embodiment, wherein the gas data comprises a gas ratio.

Embodiment 3: The method of the preceding embodiment, wherein the reservoir property comprises at least one of porosity, saturation, permeability index, fluid type, zone information, fluid contacts, connectivity, and fractures.

Embodiment 4: The method of any of the above preceding embodiments, further comprising determining a region of interest of a reservoir based on the reservoir property, wherein the adjusting of the drilling direction is performed to maintain the wellbore within the region of interest.

Embodiment 5: The method of any of the above preceding embodiments, further comprising continuously monitoring at least one of the gas data and the reservoir property to confirm the drilling direction.

Embodiment 6: The method of any of the above preceding embodiments, further comprising: combining the reservoir property with at least one of resistivity data, gamma ray data, image data, density data, nuclear magnetic resonance data, porosity data, and petrophysical data to create combined data; and setting a well trajectory based on the combined data.

Embodiment 7: The method of any of the above preceding embodiments, further comprising combining the determined reservoir property with formation dip information and adjusting the drilling direction based on the determined reservoir property and the formation dip information.

Embodiment 8: The method of any of the above preceding embodiments, wherein the drilling direction is based on a well plan and the adjusting further comprises an adjustment of the well plan.

Embodiment 9: The method of the preceding embodiment, wherein the well plan comprises a horizontal borehole section.

Embodiment 10: The method of any of the above preceding embodiments, wherein the gas data is scaled by a function of a rate of penetration or caliper.

Embodiment 11: A system for controlling a drilling operation, the system comprising: a drilling tool in a wellbore arranged to perform the drilling operation, the drilling operation having a drilling direction, wherein drilling mud is conveyed from the earth surface to the drilling tool and returned to the earth surface; a mud logger operable to obtain gas data from the drilling mud that returns to the earth surface; a control unit configured to determine a reservoir property from the gas data; and one or more geosteering components located at at least one of the surface and downhole configured to adjust the drilling direction based on the determined reservoir property.

Embodiment 12: The system of the above preceding embodiment, wherein the gas data comprises a gas ratio.

Embodiment 13: The system of the above preceding embodiment, wherein the reservoir property comprises at least one of porosity, saturation, permeability index, zone information, fluid contacts, connectivity, fracture, and fluid type.

Embodiment 14: The system of any of the above preceding embodiments, wherein the control unit is configured to determine a region of interest of a reservoir based on the reservoir property, wherein the adjusting of the drilling direction is performed to maintain the wellbore within the region of interest.

Embodiment 15: The system of any of the above preceding embodiments, wherein the control unit is configured to continuously monitor at least one of the gas data and the reservoir property to confirm the drilling direction.

Embodiment 16: The system of any of the above preceding embodiments, wherein the control unit is configured to combine the reservoir property with at least one of resistivity data, gamma ray data, image data, density data, nuclear magnetic resonance data, porosity data, and petrophysical data to create combined data and set a well trajectory based on the combined data.

Embodiment 17: The system of any of the above preceding embodiments, wherein the control unit is configured to combine the determined reservoir property with formation dip information and to adjust the drilling direction based on the determined reservoir property and the formation dip information.

Embodiment 18: The system of any of the above preceding embodiments, wherein the drilling direction is based on a well plan and the adjusting further comprises an adjustment of the well plan.

Embodiment 19: The system of the above preceding embodiment, wherein the well plan comprises a horizontal borehole section.

Embodiment 20: The system of any of the above preceding embodiments, wherein the gas data is scaled by a function of rate of penetration or caliper.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" or "substantially" used in connection with a quantity is inclusive of the stated value and has the meaning dictated by the context (e.g., it includes the degree of error associated with measurement of the particular quantity). For example, the phrase "substantially constant" is inclusive of minor deviations with respect to a fixed value or direction, as will be readily appreciated by those of skill in the art.

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method for controlling a drilling operation, the method comprising:

conveying a drilling tool from the earth surface into a wellbore and operating the drilling tool to drill in a drilling direction, wherein drilling mud is conveyed from the earth surface to the drilling tool and returned to the earth surface;

receiving the returned drilling mud at a mud logger at the earth surface and obtaining gas ratio at the earth surface from the drilling mud using the mud logger;

normalizing the gas ratio by a function of rate of penetration or caliper;

determining a reservoir property from the normalized gas ratio, wherein the reservoir property comprises at least both a saturation and a permeability index; and adjusting the drilling direction based on the determined reservoir property.

2. A system for controlling a drilling operation, the system comprising:

a drilling tool in a wellbore arranged to perform the drilling operation, the drilling operation having a drilling direction, wherein drilling mud is conveyed from the earth surface to the drilling tool and returned to the earth surface;

a mud logger configured to receive the drilling mud when it returns to the earth surface and operable to obtain gas concentration, gas composition, and/or gas ratio from the drilling mud that returns to the earth surface;

a control unit configured to normalize the gas concentration, gas composition, and/or gas ratio by a function of rate of penetration or caliper and determine a reservoir property from the normalized gas concentration, gas composition, and/or gas ratio, wherein the reservoir property comprises at least one of a hydrocarbon saturation and a permeability index; and one or more geosteering components located at at least one of the earth surface and downhole configured to adjust the drilling direction based on the determined reservoir property.

3. The system of claim 2, wherein the control unit is configured to:

normalize the gas concentration, gas composition, and/or gas ratio by a function of both rate of penetration and caliper; and determine the reservoir property from the normalized gas concentration, gas composition, and/or gas ratio.

4. The system of claim 3, wherein the reservoir property further comprises at least one of porosity, fluid type, zone information, fluid contacts, connectivity, and a fracture.

5. The system of claim 2, wherein the control unit is configured to determine a region of interest of a reservoir based on the reservoir property, wherein the adjusting of the drilling direction is performed to maintain the wellbore within the region of interest.

6. The system of claim 2, wherein the control unit is configured to continuously monitor the gas concentration, gas composition, and/or gas ratio and the reservoir property to confirm the drilling direction.

7. The system of claim 2, wherein the control unit is configured to combine the reservoir property with at least one of resistivity data, gamma ray data, image data, density data, nuclear magnetic resonance data, and porosity data to create combined data and adjust the drilling direction based on the combined data.

8. The system of claim 2, wherein the control unit is configured to combine the determined reservoir property with formation dip information and to adjust the drilling direction based on the determined reservoir property and the formation dip information.

9. The system of claim 2, wherein the drilling direction is based on a well plan and the adjusting further comprises an adjustment of the well plan.

10. The system of claim 9, wherein the well plan comprises a horizontal borehole section.

11. The system of claim 2, wherein the reservoir property further comprises at least one of porosity, zone information, fluid contacts, connectivity, and a fracture.

12. A method for controlling a drilling operation, the method comprising:

conveying a drilling tool from the earth surface into a wellbore and operating the drilling tool to drill in a drilling direction, wherein drilling mud is conveyed from the earth surface to the drilling tool and returned to the earth surface;

logging, at the earth surface from the drilling mud returned to the earth surface, gas ratio from the drilling mud;

scaling the gas ratio by a scaling factor that is a function of a rate of penetration or caliper;

determining a reservoir property from the scaled gas ratio, wherein the reservoir property comprises at least both a saturation and a permeability index; and adjusting the drilling direction based on the determined reservoir property.

13. A method for controlling a drilling operation, the method comprising:

conveying a drilling tool from the earth surface into a wellbore and operating the drilling tool to drill in a drilling direction, wherein drilling mud is conveyed from the earth surface to the drilling tool and returned to the earth surface;

receiving the returned drilling mud at a mud logger at the earth surface and obtaining gas concentration, gas composition, and/or gas ratio at the earth surface from the drilling mud using the mud logger;

normalizing the gas concentration, gas composition, and/or gas ratio by a function of rate of penetration or caliper;

determining a reservoir property from the normalized gas concentration, gas composition, and/or gas ratio, wherein the reservoir property comprises at least one of a hydrocarbon saturation and a permeability index; and adjusting the drilling direction based on the determined reservoir property.

14. The method of claim 13, wherein the normalizing of the gas concentration, gas composition, and/or gas ratio is by a function of both rate of penetration and caliper; and the reservoir property is determined from the normalized gas concentration, gas composition, and/or gas ratio.

15. The method of claim 14, wherein the reservoir property further comprises at least one of porosity, fluid type, zone information, fluid contacts, connectivity, and fractures.

16. The method of claim 13, further comprising determining a region of interest of a reservoir based on the reservoir property, wherein the adjusting of the drilling direction is performed to maintain the wellbore within the region of interest.

17. The method of claim 13, further comprising continuously monitoring the gas concentration, gas composition, and/or gas ratio and the reservoir property to confirm the drilling direction.

18. The method of claim 13, further comprising:

combining the reservoir property with at least one of resistivity data, gamma ray data, image data, density data, nuclear magnetic resonance data, and porosity data to create combined data; and adjusting the drilling direction based on the combined data.

19. The method of claim 13, further comprising combining the determined reservoir property with formation dip information and adjusting the drilling direction based on the determined reservoir property and the formation dip information.

20. The method of claim 13, wherein the drilling direction is based on a well plan and the adjusting further comprises an adjustment of the well plan.

21. The method of claim 20, wherein the well plan comprises a horizontal borehole section.

22. The method of claim 13, wherein the reservoir property further comprises at least one of porosity, zone information, fluid contacts, connectivity, and a fracture.

23. A method for controlling a drilling operation, the method comprising:

conveying a drilling tool from the earth surface into a wellbore and operating the drilling tool to drill in a drilling direction, wherein drilling mud is conveyed from the earth surface to the drilling tool and returned to the earth surface;

receiving the returned drilling mud at a mud logger at the earth surface;

obtaining gas information at the earth surface from the drilling mud using the mud logger, wherein the gas information comprises one of (i) a gas ratio, (ii) the gas ratio and a gas concentration, (iii) the gas ratio and a gas composition, or (iv) the gas ratio, the gas concentration, and the gas composition;

normalizing at least a part of the gas information by a function of rate of penetration or caliper;

determining a reservoir property from the normalized gas information, wherein the reservoir property comprises at least both a saturation and a permeability index; and adjusting the drilling direction based on the determined reservoir property.

* * * * *